US006641915B1

(12) United States Patent
Kasabo et al.

(10) Patent No.: US 6,641,915 B1
(45) Date of Patent: Nov. 4, 2003

(54) ACRYLONITRILE-BASED FIBER BUNDLE FOR CARBON FIBER PRECURSOR AND METHOD FOR PREPARATION THEREOF

(75) Inventors: Yukio Kasabo, Hiroshima (JP); Katsuhiko Ikeda, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/275,892

(22) PCT Filed: May 9, 2000

(86) PCT No.: PCT/JP00/02951

§ 371 (c)(1),
(2), (4) Date: Nov. 12, 2002

(87) PCT Pub. No.: WO01/86040

PCT Pub. Date: Nov. 15, 2001

(51) Int. Cl.[7] ..... D01F 6/00; D01F 9/12

(52) U.S. Cl. ..... 428/364; 428/394; 428/400; 264/206; 264/182; 264/291; 264/292

(58) Field of Search ..... 428/364, 394, 428/400; 264/206, 182, 291, 292

(56) References Cited

U.S. PATENT DOCUMENTS

| | | | | |
|---|---|---|---|---|
| 4,663,232 A | * | 5/1987 | Kamide et al. | 428/400 |
| 5,286,844 A | | 2/1994 | Nishida et al. | 528/482 |
| 5,344,711 A | * | 9/1994 | Kanzaki et al. | 428/398 |
| 6,245,423 B1 | | 6/2001 | Ikeda et al. | 428/264 |
| 6,428,891 B1 | | 8/2002 | Okuya et al. | 428/364 |
| 6,503,624 B2 | | 1/2003 | Ikeda et al. | 428/364 |

FOREIGN PATENT DOCUMENTS

| | | |
|---|---|---|
| JP | 2-80610 | 3/1990 |
| JP | 3-113012 | 5/1991 |
| JP | 5-5224 | 5/1993 |
| JP | 5-132813 | 5/1993 |
| JP | 2000-144521 | 5/2000 |

* cited by examiner

*Primary Examiner*—N. Edwards
(74) *Attorney, Agent, or Firm*—Oblon, Spivak, McClelland, Maier & Neustadt, P.C.

(57) ABSTRACT

There is disclosed an acrylonitrile fiber bundle for a carbon fiber precursor with a total denier of 30,000 or more consisting of an acrylonitrile polymer comprising 95 wt % or more of an acrylonitrile unit, wherein the surface of filaments composing of the fiber bundle has 2 to 15 corrugation with a height of 0.5 to 1.0 $\mu$m which are substantially continuous in a longitudinal direction and an iodine adsorption per a fiber weight of the fiber bundle is 0.5 to 1.5 wt %. The fiber bundle shows a large total size, a small drying load owing to its good denseness and a good convergence so that it is suitably used as precursors for carbon fibers.

14 Claims, 2 Drawing Sheets

ACRYLONITRILE-BASED FIBER BUNDLE FOR CARBON FIBER PRECURSOR AND METHOD FOR PREPARATION THEREOF

TECHNICAL FIELD

This invention relates to an acrylonitrile fiber bundle suitable for producing carbon fibers used in premium applications such as airplanes and sports or general industrial applications.

BACKGROUND ART

Demands for carbon fibers have been increased in recent years, and the carbon fibers have gained a wide application such as premium applications for airplanes and sports goods, and general industrial applications typified by civil engineering. Currently, acrylonitrile fiber bundles with an acrylonitrile filament number of 10,000 to 20,000 are wound by a filament winding method and carbonized to give carbon fibers, and several filaments of the carbon fibers are aligned for molding.

Since several carbon fibers are aligned after the carbonization in the above procedure, however, gaps tend to generate between aligned carbon fibers. This leads to molding defects of a reduced strength or elastic modulus in a molding from carbon fibers. In addition, the process of aligning multiple carbon fibers results in complexity and an increased cost in molding production.

For solving these problems, attempts have been recently made for increasing the filament number in an acrylonitrile fiber bundle as precursor for carbon fibers.

Unduly increasing the filament number of an acrylonitrile fiber bundle may, however, cause increase in tow handling or a tow volume. It may increase a load in drying step in an existing apparatus so that spinning cannot be performed with a high speed. Furthermore, an increased tow volume may cause a problem of merging between fiber bundles, leading to significant deterioration in product quality.

It has been thus needed to provide an acrylonitrile fiber bundle showing a higher total size, improved denseness, a reduced load in drying step and an improved convergence, which is suitable for the use as a precursor for a carbon fiber.

An objective of this invention is, therefore, to provide an acrylonitrile fiber bundle suitable for the use as a precursor for carbon fiber due to its higher total size, improved denseness, reduced drying load and improved convergence.

Another objective of this invention is to provide a process for easily and accurately producing an acrylonitrile fiber bundle suitable for the use as a precursor for carbon fiber due to its higher total size, improved denseness, reduced drying load and improved convergence.

DISCLOSURE OF THE INVENTION

The above problems can be solved by an acrylonitrile fiber bundle according to this invention and a production process therefor described below.

This invention provides an acrylonitrile fiber bundle for a carbon fiber precursor with a total size of 30,000 denier or more consisting of an acrylonitrile polymer comprising 95 wt % or more of an acrylonitrile unit, wherein the surface of filaments composing of the fiber bundle has 2 to 15 corrugations with a height of 0.5 to 1.0 $\mu$m which are substantially continuous in a longitudinal direction and the amount of iodine adsorbable to a fiber is 0.5 to 1.5 wt % of the fiber bundle.

A process for producing an acrylonitrile fiber bundle for a carbon fiber precursor according to this invention comprises the steps of discharging a spinning feed solution of an acrylonitrile polymer having 95 wt % or more of an acrylonitrile unit dissolved in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber; drawing the coagulated fiber from the first coagulation bath at a drawing rate which is 0.8 folds or less of the linear discharge velocity of the spinning feed solution; and then stretching the coagulated fiber to 1.1 to 3.0 folds in length in a second coagulation bath at 30 to 50° C. consisting of an aqueous organic-solvent solution comprising 50 to 70 wt % of the third organic solvent capable of solving the acrylonitrile polymer.

In the process for producing an acrylonitrile fiber bundle according to this invention described above, a degree of swelling in the swollen fiber bundle before drying is preferably 70 wt % or less after 1.1 to 3.0-fold stretching in the second coagulation bath because an excessively high stretch ratio in the second coagulation bath causes reduction in a stretch ratio in post-stretching.

Another process for producing an acrylonitrile fiber bundle for a carbon fiber precursor according to this invention comprises the steps of discharging a spinning feed solution of an acrylonitrile polymer having 95 wt % or more of an acrylonitrile unit dissolved in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber; drawing the coagulated fiber from the first coagulation bath at a drawing rate which is 0.8 folds or less of the linear discharge velocity of the spinning feed solution; stretching the coagulated fiber to 1.1 to 3.0 folds in length in a second coagulation bath consisting of an aqueous organic-solvent solution comprising 50 to 70 wt % of the third organic solvent capable of solving the acrylonitrile polymer at 30 to 50° C.;. and then further wet-heat stretching the resulting fiber to 4 folds or more.

In the process for producing an acrylonitrile fiber bundle according to this invention described above, a degree of swelling in the swollen fiber bundle before drying is preferably 70 wt % or less after wet-heat stretching.

In an acrylonitrile fiber bundle of this invention and a production process therefor, an acrylonitrile polymer used is a polymer containing 95 wt % or more of acrylonitrile. The acrylonitrile polymer may be also a homopolymer or copolymer of acrylonitrile or a mixture thereof.

An acrylonitrile copolymer is a copolymerization product of acrylonitrile and a monomer copolymerizable with acrylonitrile. Examples of a monomer copolymerizable with acrylonitrile include, but not limited to, (meth)acrylates such as methyl(meth)acrylate, ethyl(meth)acrylate, propyl(meth) acrylate, butyl(meth)acrylate and hexyl(meth)acrylate; halogenated vinyl compounds such as vinyl chlorides, vinyl bromide and vinylidene chloride; acids and their salts having a polymerizable double bond such as (meth)acrylic acid, itaconic acid and crotonic acid; maleimide; phenylmaleimide; (meth)acrylamide; styrene; α-methyl styrene; vinyl acetate; polymerizable unsaturated monomers having a sulfonic group such as sodium styrenesulfonate, sodium allylsulfonate, sodium β-styrenesulfonate and sodium metaallylsulfonate; and polymerizable unsaturated monomers having a pyridine group such as 2-vinylpyridine and 2-methyl-5-vinylpyridine.

Polymerization may be conducted by, but not limited to, redox polymerization in an aqueous solution, suspension polymerization in a heterogeneous system and emulsion polymerization using a dispersant.

An acrylonitrile fiber bundle for a carbon fiber precursor according to this invention has a total denier of 30,000 (33,000 dtex) or more, and the surface of filaments composing of the fiber bundle has 2 to 15 corrugation with a height of 0.5 to 1.0 μm which are substantially continuous in a longitudinal direction of the fiber. The term "corrugation" as used herein refers to a continuous convex observed in a longitudinal direction in a 10 μm×10 μm visual field of a randomly selected fiber surface, and such corrugations are counted.

The presence of such corrugations allows an acrylonitrile fiber bundle of this invention to exhibit a good convergence and allows carbon fibers from the precursor fiber bundle to exhibit a good spreadability (spread property) when being used in pre-preg production.

An excessively tall corrugations increases the surface area of the fiber bundle, causing generation of static electricity and reduction in a convergence of the fiber bundle, while an excessively low corrugation fails to give the above improvement associated with the presence of corrugations, i. e., a good convergence and a good spreadability when producing a pre-preg using carbon fibers from the precursor fiber bundle.

A height of corrugation is, therefore, preferably 0.6 to 0.8 μm. A width of corrugation is about 0.5 to 1.0 μm, preferably 0.6 to 0.8 μm.

An excessively large number of the above corrugations leads to increase in the surface area of a fiber bundle, causing generation of static electricity and a reduced convergence of the fiber bundle, while an excessively small number of the corrugations fails to give the above improvement associated with the presence of corrugations, i. e., a good convergence and a good spreadability when producing a pre-preg using carbon fibers from the precursor fiber bundle.

The number of the corrugations on a filament constituting a fiber bundle of this invention is generally 2 to 15, preferably 12 to 15. However, the range defined herein for the number of the corrugations is not necessarily applied for all of the filaments constituting the fiber bundle; specifically, 80% or more, preferably 90% or more, more preferably 95% or more of the filaments may have the corrugation number within the above range.

In a fiber bundle of this invention, the amount of iodine adsorbable to fiber must be 0.5 to 1.5 wt %, preferably 0.5 to 1.0 wt %. The amount of iodine adsorption is a measure for denseness of an acrylonitrile fiber bundle as determined according to the iodine adsorption method described in JP-A 63-85168.

Method for Determining the Amount of Iodine Adsorption

In a 200 mL Erlenmeyer flask equipped with a ground stopper is placed a precisely weighed about 0.5 g of a dried sample with a fiber length of 5 to 7 cm. To the sample is added 100 mL of an iodine solution (prepared by weighing 51 g of $I_2$, 10 g of 2,4-dichlorophenol, 90 g of acetic acid and 100 g of potassium iodide, placing the mixture in a 1 liter volumetric flask, dissolving it in water to volume (1 liter)), and the mixture is shaken at 60±0.5° C. for 50 min. After adsorption processing, the sample adsorbing iodine is washed with running water for 30 min. dried by centrifugation (2000 rpm×1 min) and immediately air-dried. The sample obtained is precisely weighed to give a weight increase, from which the amount of iodine adsorbable to fiber is then determined.

A too low amount of iodine adsorption in the fiber bundle indicates that denseness of the fiber bundle is too high, that is, denseness in the fiber surface is so high that the fiber surface is disadvantageously smooth. On the other hand, a too high amount of iodine adsorption in the fiber bundle indicates too low denseness in the fiber surface. Thus, a drying load during producing an acrylonitrile fiber bundle is too high so that spinning rate cannot be increased. Furthermore, carbon fibers provided after its calcination may have significantly reduced strength.

An acrylonitrile fiber bundle of this invention shows good convergence even when it is a so-called large tow with a total denier of 30,000 (total size: 33,000 dtex) or more. In addition, the fiber bundle can be used for calcinations with large volume-density. The effect of this invention that calcinations with large volume-density can be employed may be, therefore, most effectively achieved by using a fiber bundle with a total size of 55,000 dtex or more.

A fiber bundle of this invention preferably has an electrostatic charge of −1 kV to +1 kV as determined by the method described below, for improving convergence of the fiber bundle. In particular, when the electrostatic charge is within the range of −0.5 kV to +0.5 kV, damage on filaments due to loosening of the fiber bundle can be minimized and thus associated deterioration in performance can be avoided to maintain stable and high quality.

Method for Determining an Electrostatic Charge

Two iron nip rollers plated with hard chromium are placed such that they are separated each other by 60 m. An acrylonitrile fiber bundle of the measurement is placed between the nip rollers. A sensor in STATIRON III (SHISHIDO ELECTROSTATIC Ltd.) is placed at a position of 10 cm from the winding nip roller while being separated by 0.5 cm from the acrylonitrile fiber bundle.

Then, the acrylonitrile fiber bundle is run at a rate of 50 m/min to initiate determination of a voltage. A voltage when running of the acrylonitrile fiber bundle becomes stable without voltage variation is defined as an electrostatic charge for the acrylonitrile fiber bundle.

An acrylonitrile fiber bundle of this invention may also contain an oil for adjusting a voltage of the fiber bundle within an appropriate range for further improving its convergence. Examples of such an oil include silicone oils, aromatic ester oils and sulfur-containing aliphatic ester oils. A silicone oil can improve not only convergence of the acrylonitrile fiber bundle but also strength and an elastic modulus of the carbon fiber prepared by calcination of the acrylonitrile fiber bundle.

There will be described a process for producing an acrylonitrile fiber bundle for a carbon fiber precursor according to this invention.

As described above, a process for producing an acrylonitrile fiber bundle for a carbon fiber precursor according to this invention comprises the steps of discharging a spinning feed solution of an acrylonitrile polymer having 95 wt % or more of an acrylonitrile unit dissolved in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber; drawing the coagulated fiber from the first coagulation bath at a drawing rate which is 0.8 folds or less of the linear discharge velocity of the spinning feed solution; and then stretching the coagulated fiber to 1.1 to 3.0 folds in length in a second coagulation bath at 30 to 50° C. consisting of an aqueous organic-solvent solution comprising 50 to 70 wt % of the third organic solvent capable of solving the acrylonitrile polymer.

Another process for producing an acrylonitrile fiber bundle for a carbon fiber precursor according to this invention comprises the steps of discharging a spinning feed solution of an acrylonitrile polymer having 95 wt % or more of an acrylonitrile unit dissolved in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber; drawing the coagulated fiber from the first coagulation bath at a drawing rate which is 0.8 folds or less of the linear discharge velocity of the spinning feed solution; stretching the coagulated fiber to 1.1 to 3.0 folds in length in a second coagulation bath consisting of an aqueous organic-solvent solution comprising 50 to 70 wt % of the third organic solvent capable of solving the acrylonitrile polymer at 30 to 50° C.; and then further wet-heat stretching the resulting fiber to 4 folds or more.

All of the first to third organic solvents used herein are organic solvents which can dissolve an acrylonitrile polymer; for example, dimethyl acetamide, dimethylsulfoxide and dimethylformamide.

A spinning feed solution may be a solution in an organic solvent prepared by dissolving an acrylonitrile polymer in a first organic solvent. The first organic solvent is particularly preferably dimethylacetamide because it scarcely deteriorates the properties of the spinning solution due to hydrolysis of the solvent so that it provides a spinning feed solution with good spinnability and after calcination of an acrylonitrile fiber bundle, provides a carbon fiber exhibiting stable performance.

A spinneret for extruding a spinning feed solution may be one having an aperture for preparing an acrylic filament with a common diameter in spinning, i. e., about 1.0 dtex, that is, a spinneret having a nozzle opening with an aperture of 15 to 100 $\mu$m. In particular, a spinneret having a nozzle opening with an aperture of 15 to 50 $\mu$m, for setting "a drawing rate for a coagulated fiber/a linear discharge velocity of a spinning feed solution from the nozzle" to 0.8 or less to maintain good spinnability.

The conditions defined in this invention for the first coagulation bath and the second coagulation bath, and also the stretching conditions in the second coagulation bath are important for improving an alignment of an acrylonitrile fiber bundle prepared.

As described above, both concentrations of the second organic solvent in the first coagulation bath and of the third organic solvent in the second coagulation bath are 50 to 70 wt %, and for homogeneous coagulation of the coagulated fiber, it is preferable that the organic solvent concentrations of these coagulation baths is substantially identical. Specifically, a difference in an organic solvent concentration between these coagulation baths is 5 wt % or less, preferably 3 wt % or less.

It is also preferable that the first and the second coagulation baths are set to the substantially same temperature for homogeneous coagulation of a coagulated fiber. A temperature difference between the first and the second coagulation baths is 5° C. or less, particularly 3° C. or less.

It is also preferable that these organic solvents are identical. Particularly preferably, the first to the third solvents are identical not only for homogeneous coagulation of the coagulated fiber but also for facilitating solvent recovery.

It is, therefore, most preferable to use dimethylacetamide as the first organic solvent for the spinning feed solution, the second organic solvent in the first coagulation bath and the third organic solvent in the second coagulation bath.

The coagulated fiber drawn from the first coagulation bath is in a semi-coagulated state where only the surface of the coagulated fiber has been coagulated because a concentration of an organic solvent in a liquid absorbed in the coagulated fiber is higher than a concentration of the organic solvent in the first coagulation bath. The coagulated fiber in such a state can be drawn from the first coagulation bath to improve stretchability in the second coagulation bath.

As described later, it is important that the drawing rate of the coagulated fiber from the first coagulation bath is 0.8 folds or less of a linear discharge velocity of a spinning feed solution for homogeneous coagulation in the first coagulation bath. It is particularly preferably 0.5 folds or less, but since a too low rate may fail to achieve homogeneous coagulation, it is generally 0.3 folds or more.

Although a swollen coagulated fiber containing a coagulation solution may be stretched in the air, the coagulated fiber may be stretched in the second coagulation bath as described above to accelerate coagulation of the coagulated fiber and facilitate temperature control in the stretching process.

Stretching of a coagulated fiber in the second coagulation bath at a stretching ratio of more than 3 may tend to generate break and/or fuzz in filaments, for example, during wet-heat stretching such as boiling-water stretching. Furthermore, stretching at a stretching ratio of more than 4 generates break and/or fuzz in filaments in the second coagulation bath, leading to failure to spinning. On the other hand, stretching at a stretching ratio of less than 1.1 or less cannot give an alignment effect of an acrylonitrile fiber bundle by stretching in the second coagulation bath.

When conducting further wet-heat stretching after the stretching in the second coagulation bath, a stretching ratio in the second coagulation bath is preferably 2.0 or less so as to improve stretchability in the wet-heat stretching.

Then, a swollen fiber bundle after stretching in the second coagulation bath is washed with water and dried to give a desired acrylonitrile fiber bundle.

Alternatively, a swollen fiber bundle after stretching in the second coagulation bath is subject to wet-heat stretching for further improving fiber alignment, and dried to give a desired acrylonitrile fiber bundle. Wet-heat stretching maybe conducted by, after stretching in the second coagulation bath, stretching a swollen fiber bundle while being washed with water, or by stretching it in hot or boiling water for improving a productivity.

A swollen fiber bundle after stretching in the second coagulation bath may be stretched after dried. However, stretching after drying may tend to generate static electricity which causes significant deterioration of a convergence. Thus, when preparing an acrylonitrile fiber bundle with a total size of 33,000 dtex or more according to this invention, stretching after stretching in the second coagulation bath may be preferably wet-hot stretching. Specifically, stretching in the second coagulation bath and subsequent wet-heat stretching at a ratio of 4 or more may provide a dense acrylonitrile fiber bundle without significant deterioration in a convergence associated with a stretching process. Here, a stretching ratio in such wet-heat stretching may be determined as appropriate; for example, 8 or less.

In a process of this invention, a degree of swelling of a swollen fiber bundle before drying after stretching is preferably 70 wt % or less for preparing a high-performance carbon fibers using the fiber bundle as a precursor. Furthermore, by reducing a ratio of "drawing rate for coagulated fiber/a linear discharge velocity of a spinning feed solution from the nozzle" during preparation of a coagulated fiber in the first coagulation bath, homogeneous coagulation of a coagulated fiber in the first coagulation bath can be achieved. Then, the fiber may be stretched in the second coagulation bath for giving a fiber homogeneously aligned to its inside to give a degree of swelling of 70 wt % or less in the swollen fiber bundle before drying after stretching.

In other words, a higher ration of "drawing rate for coagulated fiber/linear discharge velocity of a spinning feed solution from the nozzle" during preparation of a coagulated fiber in the first coagulation bath may lead to simultaneous occurrence of coagulation and stretching, resulting in heterogeneous coagulation of the coagulated fiber in the first coagulation bath. Therefore, stretching it in the second coagulation bath provides a poorly swollen fiber bundle before drying after stretching, i. e., it fails to provide fiber homogeneously aligned to its inside.

A degree of swelling of a swollen fiber bundle before drying is determined according to the following equation:

$$\textit{Degree of swelling}(\%)=(w-w_0)\times 100/w_0$$

wherein w is a weight after removing adhered liquid on a swollen fiber bundle using a centrifuge (3000 rpm, 15 min) and $w_0$ is a weight after drying in a hot-air drier at 110° C. for 2 hours.

In the production process of this invention, a fiber bundle after stretching in the second coagulation bath or after stretching in the second coagulation bath and subsequent wet-heat stretching may be dried by a known drying method to give a desired acrylonitrile fiber bundle.

An acrylonitrile fiber bundle of this invention shows dense fiber density and gives a higher productivity. It may be, therefore, used as a precursor for a high-performance carbon fiber as described. Since it provides higher strength, it may be used in a reinforcing fiber in industrial materials as a chopped fiber as such, utilizing chemical resistance of the acrylonitrile fiber.

DETAILED DESCRIPTION OF PREFERRED EMBODIMENTS

There will be described particular embodiments of an acrylonitrile fiber bundle according to this invention and a production process therefor.

In these Examples, corrugations were observed by surface scanning electron microscopy to visualize morphology of a fiber surface at high magnification, and corrugations continuously observed in a longitudinal direction within a range of 10 μm×10 μm on a randomly selected fiber surface were counted.

EXAMPLE 1

Acrylonitrile, methyl acrylate and methacrylic acid were copolymerized by aqueous suspension polymerization using ammonium persulfate-ammonium hydrogen sulfite and ferrous sulfate to give an acrylonitrile copolymer with acrylonitrile unit/methyl acrylate unit/methacrylic acid unit =95/4/1 (by weight). The copolymer was dissolved in dimethylacetamide to prepare a 21 wt % spinning feed solution.

The spinning feed solution was discharged into the first coagulation bath consisting of a 65 wt % aqueous solution of dimethylacetamide at 35° C. through a spinneret with 50,000 holes of hole diameter of 60 μm to provide coagulated fibers. Then, the coagulated fibers were drawn from the first coagulation bath at a drawing rate of 0.4 folds of the linear discharge velocity of the spinning feed solution. The coagulated fibers were then introduced into the second coagulation bath consisting of a 65 wt % aqueous solution of dimethylacetamide at 35° C. for 1.2-fold stretching in the bath. Then, the fibers were subject to 2.0-fold stretching while being washed with water and then to 2.5-fold stretching in boiling water.

After treating with an oil, the fibers were dried on hot rolls and wound with a winder to give an acrylonitrile fiber bundle with a monofilament size of 1.1 dtex. In the process, a final spinning rate (i.e. processing rate) was 80 m/min.

The acrylonitrile fiber bundle was in a good drying state, and the surface of a filament in the acrylonitrile fiber bundle had five corrugations with a height of 1.0 μm substantially aligned in the longitudinal direction of the fiber bundle.

The amount of iodine adsorbable for the acrylonitrile fiber bundle was determined and was 1.0 wt % per a fiber weight. A degree of swelling for the acrylonitrile fiber bundle after wet-heat stretching was 65 wt %. A strand strength for carbon fibers prepared by calcination of the acrylonitrile fiber bundle was 400 kg/mm$^2$.

EXAMPLE 2

The spinning feed solution prepared as described in Example 1 was discharged into the first coagulation bath consisting of a 60 wt % aqueous solution of dimethylacetamide at 35° C. through a spinneret with 50,000 holes of hole diameter of 45 μm to provide coagulated fibers. Then, the coagulated fibers were drawn from the first coagulation bath at a drawing rate of 0.3 folds of the linear discharge velocity of the spinning feed solution. The coagulated fibers were then introduced into the second coagulation bath consisting of a 60 wt % aqueous solution of dimethylacetamide at 40° C. for 1.2-fold stretching in the bath. Then, the fibers were subject to 2.0-fold stretching while being washed with water and then to 2.5-fold stretching in boiling water.

After treating with an oil, the fibers were dried on hot rolls and wound with a winder to give an acrylonitrile fiber bundle with a monofilament size of 1.1 dtex. In the process, a final spinning rate was 80 m/min.

The acrylonitrile fiber bundle was in a good drying state, and the surface of a filament in the acrylonitrile fiber bundle had three corrugations with a height of 0.8 μm substantially aligned in the longitudinal direction of the fiber bundle.

The amount of iodine adsorbable for the acrylonitrile fiber bundle was 0.8 wt % per a fiber weight. A degree of swelling for the acrylonitrile fiber bundle after wet-heat stretching was 65 wt %. A strand strength for carbon fibers prepared by calcination of the acrylonitrile fiber bundle was 410 kg/mm$^2$.

EXAMPLE 3

Acrylonitrile, acrylic acid and methacrylic acid were copolymerized by aqueous suspension polymerization using ammonium persulfate-ammonium hydrogen sulfite and ferrous sulfate to give an acrylonitrile copolymer with acrylonitrile unit/acrylic acid unit/methacrylic acid unit=96/2/2 (by weight). The copolymer was dissolved in dimethylacetamide to prepare a 21 wt % spinning feed solution.

The spinning feed solution was discharged into the first coagulation bath consisting of a 65 wt % aqueous solution of dimethylacetamide at 30° C. through a spinneret with 50,000 holes of hole diameter of 55 μm to provide coagulated fibers. Then, the coagulated fiber were drawn from the first coagulation bath at a drawing rate of 0.3 folds of the linear discharge velocity of the spinning feed solution. The coagulated fiber were then introduced into the second coagulation bath consisting of a 65 wt % aqueous solution of dimethylacetamide at 35° C. for 1.2-fold stretching in the bath. Then, the fibers were subject to 2.0-fold stretching while being washed with water and then to 2.5-fold stretching in boiling water.

After treating with an oil, the fibers were dried on hot rolls and wound with a winder to give an acrylonitrile fiber bundle with a monofilament size of 1.1 dtex. In the process, a final spinning rate was 80 m/min.

The acrylonitrile fiber bundle was in a good drying state, and the surface of a filament in the acrylonitrile fiber bundle had four corrugations with a height of 0.7 $\mu$m substantially aligned in the longitudinal direction of the fiber bundle.

The amount of iodine adsorbable for the acrylonitrile fiber bundle was determined and was 0.8 wt % per a fiber weight. A degree of swelling for the acrylonitrile fiber bundle after wet-heat stretching was 61 wt %. A strand strength for carbon fibers prepared by calcination of the acrylonitrile fiber bundle was 420 kg/mm$^2$.

EXAMPLE 4

Acrylonitrile, acrylic acid and methacrylic acid were copolymerized by aqueous suspension polymerization using ammonium persulfate-ammonium hydrogen sulfite and ferrous sulfate to give an acrylonitrile copolymer with acrylonitrile unit/acrylic acid unit/methacrylic acid unit=96/3/1 (by weight). The copolymer was dissolved in dimethylacetamide to prepare a 21 wt % spinning feed solution.

The spinning feed solution was discharged into the first coagulation bath consisting of a 60 wt % aqueous solution of dimethylacetamide at 35° C. through a spinneret with 50,000 holes of hole diameter of 45 $\mu$m to provide coagulated fibers. Then, the coagulated fibers were drawn from the first coagulation bath at a drawing rate of 0.3 folds of the linear discharge velocity of the spinning feed solution. The coagulated fiber were then introduced into the second coagulation bath consisting of a 60 wt % aqueous solution of dimethylacetamide at 35° C. for 2.0-fold stretching in the bath. Then, the fibers were subject to 2.0-fold stretching while being washed with water and then to 2.5-fold stretching in boiling water.

After treating with an oil, the fibers were dried on hot rolls and wound with a winder to give an acrylonitrile fiber bundle with a monofilament size of 1.1 dtex. In the process, a final spinning rate was 80 m/min.

The acrylonitrile fiber bundle was in a good drying state, and the surface of a filament in the acrylonitrile fiber bundle had five corrugations with a height of 0.7 $\mu$m substantially aligned in the longitudinal direction of the fiber bundle.

The amount of iodine adsorbable for the acrylonitrile fiber bundle was 0.7 wt % per a fiber weight. A degree of swelling for the acrylonitrile fiber bundle after wet-heat stretching was 61 wt %. A strand strength for carbon fibers prepared by calcination of the acrylonitrile fiber bundle was 420 kg/mm$^2$.

Comparative Example 1

Coagulated fibers were drawn from the first coagulation bath as described in Example 1, and were then subject to 1.2-fold stretching in the air without using a second coagulation bath. After 2.0-fold stretching while being washed with water, the fibers were subject to 2.5-fold stretching in boiling water. The fibers were treated with an oil as described in Example 1, dried on hot rolls and wound using a winder to give an acrylonitrile fiber bundle with a monofilament size of 1.1 dtex. A final spinning rate was 60 m/min.

The acrylonitrile fiber bundle was not adequately dried and the surface of a filament in the acrylonitrile fiber bundle had eighteen corrugations with a height of 0.4 $\mu$m which were discontinuous in the longitudinal direction of the fiber bundle. The acrylonitrile fiber bundle was adequately dried and calcimined to give carbon fibers with a strand strength of 380 kg/mm$^2$.

Comparative Example 2

Coagulated fibers were drawn from the first coagulation bath as described in Example 1, and were then subject to 1.7-fold stretching in the air without using a second coagulation bath. After 1.4-fold stretching while being washed with water, the fibers were subject to 2.5-fold stretching in boiling water. The fibers were treated with an oil as described in Example 1, dried on hot rolls and wound using a winder to give an acrylonitrile fiber bundle with a filament size of 1.1 dtex. A final spinning rate was 60 m/min.

The surface of a filament in the acrylonitrile fiber bundle thus prepared had six corrugations with a height of 0.4 $\mu$m substantially continuous in the longitudinal direction of the fiber bundle. The amount of iodine adsorbable for the acrylonitrile fiber bundle was determined and was 2.0 wt % per a fiber weight.

A degree of swelling for the acrylonitrile fiber bundle after wet-heat stretching was 85 wt %. A carbon fibers prepared by calcination of the acrylonitrile fiber bundle had a strand strength of 390 kg/mm$^2$.

Comparative Example 3

Coagulated fibers were drawn from the first coagulation bath as described in Example 1 and was then subject to 4.0-fold stretching in the second coagulation bath consisting of a 60 wt % aqueous solution of dimethylacetamide at 35° C.. It was then subject to 2.0-fold stretching while being washed with water. Subsequently, during attempting 2.5-fold stretching was attempted in boiling water, the filaments in the acrylonitrile fiber bundle were broken and fluffed, resulting in interruption of spinning.

Comparative Example 4

Coagulated fibers were drawn from the first coagulation bath as described in Example 1. Then, the fibers were introduced into the second coagulation bath consisting of a 60 wt % aqueous solution of dimethylacetamide at 35° C. for attempting 5.0-fold stretching in the bath, but the filaments were broken and fluffed in the second coagulation bath, resulting in interruption of spinning.

FIGS. 1 and 2 show SEM (surface scanning electron microscope) photographs for Example 1 and Comparative Example 1, respectively.

Industrial Applicability

An acrylonitrile fiber bundle for a carbon fiber precursor according to this invention shows a good convergence and high denseness, and thus a small load in drying step.

Therefore, even a fiber bundle with a total size of 33,000 dtex or more can be effectively produced without reduction in a spinning rate.

Furthermore, the fiber bundle according to this invention shows a total size of 33,000 dtex or more so that, in molding process using carbon fibers prepared from the bundle of precursors, a process of aligning multiple carbon fibers can be omitted and thus the problems of complexity and a higher cost in molding production can be solved.

An acrylonitrile fiber bundle for a carbon fiber precursor according to this invention shows the iodine adsorption property, that is, the amount of iodine adsorbable to the fiber is 0.5 to 1.5 wt %. It can be, therefore, calcimined to give a very strong carbon fibers with a good convergence as described above and showing good spreadability in pre-preg production using the carbon fibers.

Furthermore, a process for producing an acrylonitrile fiber bundle for carbon fiber precursors according to this invention can readily and stably produce the above acrylonitrile fiber bundle showing good denseness, a small drying load and a good convergence which is a suitable precursors for carbon fibers.

Figure 1:
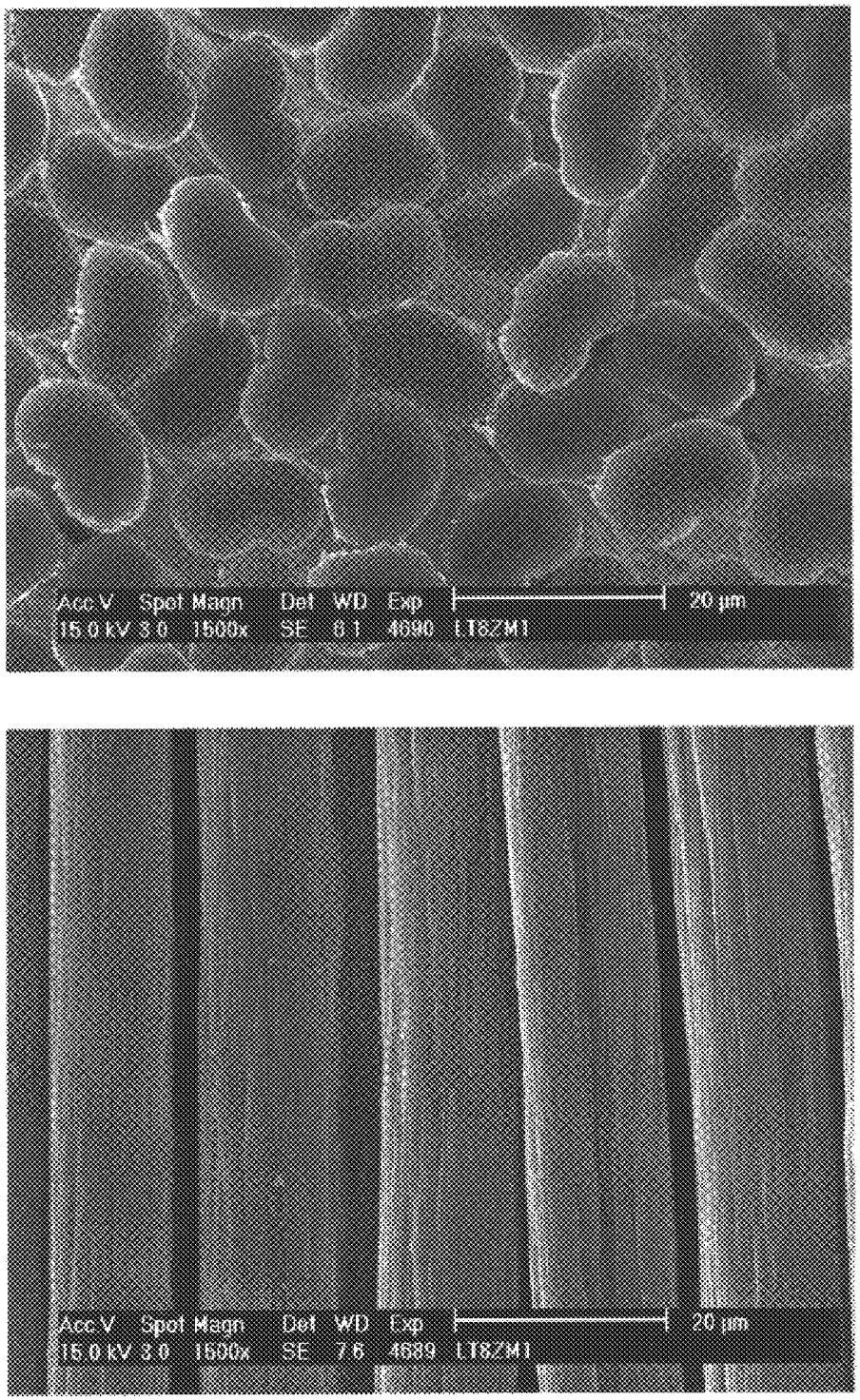
FIG. 1 is an SEM photograph of an acrylonitrile fiber bundle for a carbon fiber precursor in Example 1.
Figure 2:
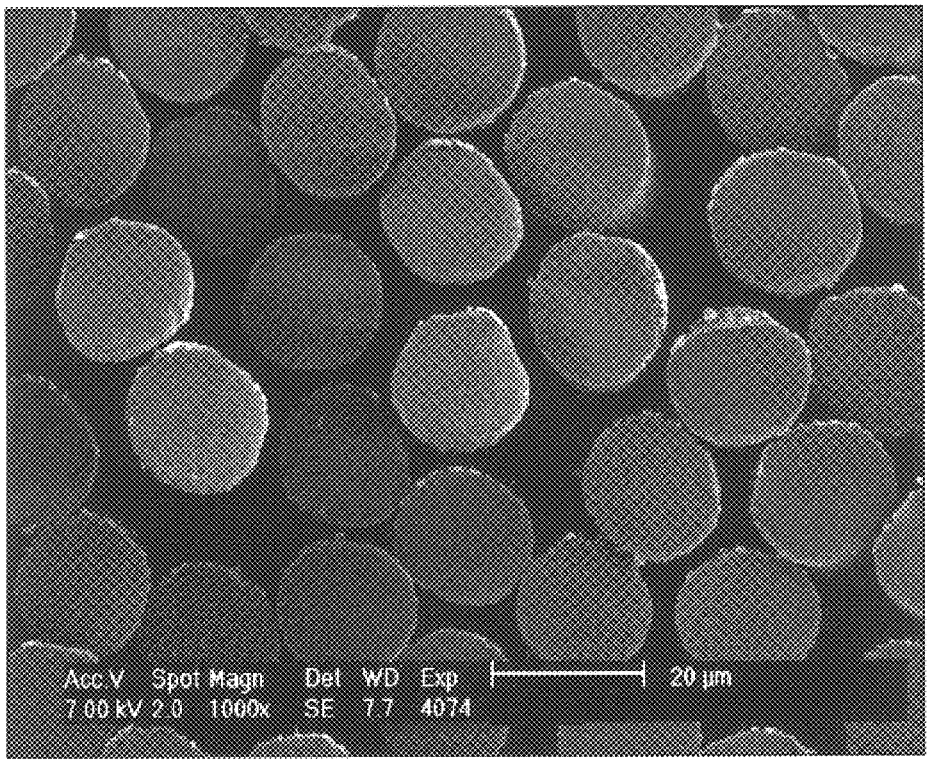
FIG. 2 is an SEM photograph of an acrylonitrile fiber bundle for a carbon fiber precursor in Comparative Example 1.
Figure 2:
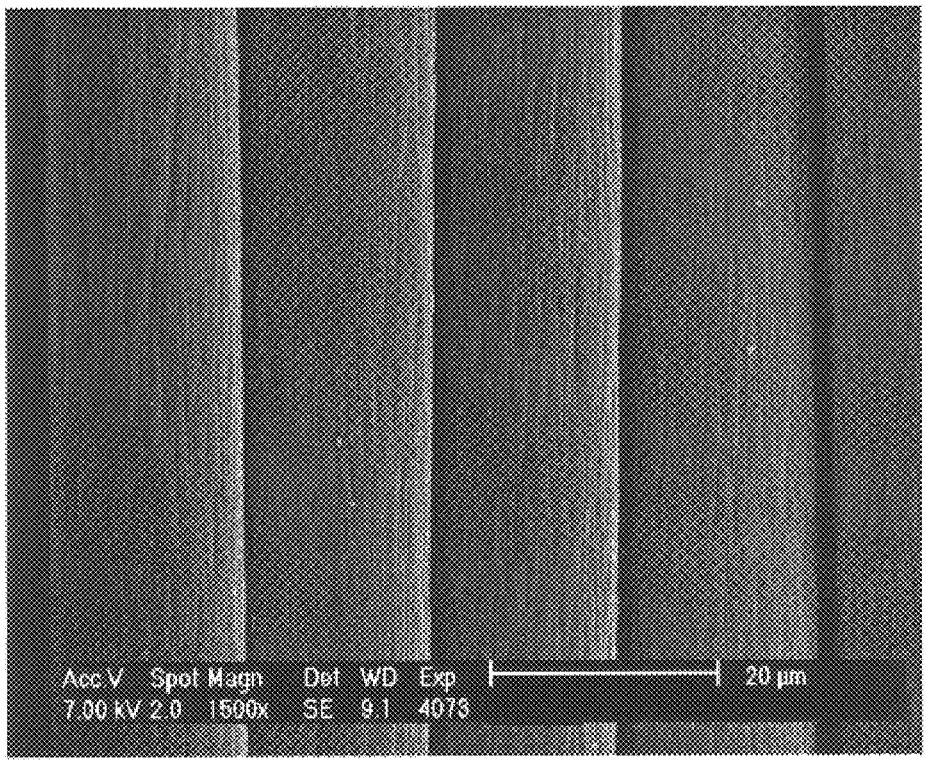

What is claimed is:

1. An acrylonitrile fiber bundle for a carbon fiber precursor with a total denier of 30,000 or more consisting of an acrylonitrile polymer comprising 95 wt % or more of an acrylonitrile unit, wherein the surface of filaments composing of the fiber bundle has 2 to 15 corrugation with a height of 0.5 to 1.0 $\mu$m which are substantially continuous in a longitudinal direction and the amount of iodine adsorbable to fiber weight of the fiber bundle is 0.5 to 1.5 wt %.

2. A process for producing an acrylonitrile fiber bundle for a carbon fiber precursor comprising the steps of:

discharging a spinning feed solution of an acrylonitrile polymer having 95 wt % or more of an acrylonitrile unit in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber;

drawing the coagulated fiber from the first coagulation bath at a drawing rate of 0.8 folds or less of the linear discharge velocity of the spinning feed solution; and then stretching the coagulated fiber to 1.1 to 3.0 folds in a second coagulation bath at 30 to 50° C. consisting of an aqueous organic-solvent solution comprising 50 to 70 wt % of the third organic solvent capable of solving the acrylonitrile polymer.

3. A process for producing an acrylonitrile fiber bundle for a carbon fiber precursor comprising the steps of:

discharging a spinning feed solution of an acrylonitrile polymer having 95 wt % or more of an acrylonitrile unit in a first organic solvent into a first coagulation bath at 30 to 50° C. consisting of an aqueous organic-solvent solution comprising 50 to 70 wt % of the second organic solvent capable of solving the acrylonitrile polymer, to prepare a coagulated fiber;

drawing the coagulated fiber from the first coagulation bath at a drawing rate of 0.8 folds or less of the linear discharge velocity of the spinning feed solution;

stretching the coagulated fiber to 1.1 to 3.0 folds in length in a second coagulation bath at 30 to 50° C. consisting of an aqueous organic-solvent solution comprising 50 to 70 wt % of the third organic solvent capable of solving the acrylonitrile polymer; and then further wet-heat stretching the resulting fiber to 4 folds or more.

4. The process as claimed in claim 2 wherein a degree of swelling in the swollen fiber bundle before drying after stretching is 70 wt % or less.

5. The process as claimed in claim 3 wherein a degree of swelling in the swollen fiber bundle before drying after stretching is 70 wt % or less.

6. The process as claimed in claim 3 wherein a stretching ratio in the second coagulation bath is 1.1 to 2.0.

7. The process as claimed in claim 2 wherein a concentration of the third organic solvent in the second coagulation bath is substantially equal to that of the second organic solvent in the first coagulation bath.

8. The process as claimed in claim 3 wherein a concentration of the third organic solvent in the second coagulation bath is substantially equal to that of the second organic solvent in the first coagulation bath.

9. The process as claimed in claim 4 wherein a concentration of the third organic solvent in the second coagulation bath is substantially equal to that of the second organic solvent in the first coagulation bath.

10. The process as claimed in claim 5 wherein a concentration of the third organic solvent in the second coagulation bath is substantially equal to that of the second organic solvent in the first coagulation bath.

11. The process as claimed in claim 2 wherein the first, the second and the third organic solvents are identical.

12. The process as claimed in claim 3 wherein the first, the second and the third organic solvents are identical.

13. The process as claimed in claim 4 wherein the first, the second and the third organic solvents are identical.

14. The process as claimed in claim 5 second and the third organic solvents are identical.

* * * * *